US009574836B1

(12) United States Patent
Cauley, Jr. et al.

(10) Patent No.: US 9,574,836 B1
(45) Date of Patent: Feb. 21, 2017

(54) FIREARM MAGAZINE LOADER

(71) Applicant: Battenfeld Technologies, Inc., Columbia, MO (US)

(72) Inventors: Dennis W. Cauley, Jr., Booneville, MO (US); Michael Cottrell, Columbia, MO (US); Jeremy Harvey, Columbia, MO (US); Glenn He, Columbia, MO (US); Tim Kinney, Columbia, MO (US); Michael Poehlman, Columbia, MO (US); James Tayon, Moberly, MO (US); James Gianladis, Harrisburg, MO (US); Adam J. Birk, Hallsville, MO (US); Matthew Kinamore, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 15/015,993

(22) Filed: Feb. 4, 2016

(51) Int. Cl.
*F41A 9/83* (2006.01)
*F41A 9/84* (2006.01)

(52) U.S. Cl.
CPC ... *F41A 9/83* (2013.01); *F41A 9/84* (2013.01)

(58) Field of Classification Search
CPC ..... F41A 9/83; F41A 9/84
USPC ..... 42/87, 88; 86/47
See application file for complete search history.

(56) References Cited

U.S. PATENT DOCUMENTS 452,447 A 5/1891 Bruce
1,011,541 A * 12/1911 West ..... F41A 9/84 42/18
1,178,785 A 4/1916 Debuchy
1,295,038 A * 2/1919 Johnson ..... F41A 9/83 86/47
1,295,039 A 2/1919 Johnson
1,355,684 A 10/1920 Northover
1,786,537 A 12/1930 Holek
1,840,477 A 1/1932 Von Frommer
2,014,177 A 9/1935 Herlach et al.
2,191,130 A 2/1940 Ludwig
2,345,593 A 4/1944 Garand
2,402,195 A * 6/1946 Woodberry ..... F42B 39/10 42/88

(Continued)

FOREIGN PATENT DOCUMENTS

EP 0205661 A2 12/1986
GB 379179 8/1932

(Continued)

OTHER PUBLICATIONS

Amazon.com: ProMag RD USGI Magazine Loader Black Polymer http://www.amazon.com/ProMag-Magazine-Loader-Black-Polymer/dp/B002IWRFLK, 2 pages, Jul. 15, 2014.

(Continued)

*Primary Examiner* — Bret Hayes
(74) *Attorney, Agent, or Firm* — Senniger Powers LLP

(57) ABSTRACT

Firearm magazine loader, associated components, and methods of use. The loader can be configured to load rounds of ammunition from a stripper clip into a firearm magazine. A stripper clip ejector can eject stripper clips from the loader. An ammunition transfer tool can be used for loading rounds of ammunition not on a stripper clip into the firearm magazine loader.

20 Claims, 12 Drawing Sheets

(56) References Cited

U.S. PATENT DOCUMENTS

| | | | | |
|---|---|---|---|---|
| 2,403,012 | A * | 7/1946 | McPheters | F41A 9/83 42/87 |
| 2,462,836 | A * | 3/1949 | Barker | F41A 9/83 42/87 |
| 2,487,040 | A | 11/1949 | Bilobeau | |
| 2,526,195 | A | 10/1950 | Brownsey | |
| 2,542,842 | A | 2/1951 | Saunders | |
| 2,783,570 | A | 3/1957 | Kunz | |
| 2,887,811 | A * | 5/1959 | Johnson, Jr. | F41A 9/84 42/87 |
| 2,894,350 | A * | 7/1959 | Janson | F41A 9/84 42/50 |
| 3,030,724 | A | 4/1962 | Curran | |
| 3,099,958 | A | 8/1963 | Daubenspeck et al. | |
| 3,292,293 | A | 12/1966 | Chiasera | |
| 4,506,588 | A | 3/1985 | Kazanjy | |
| 4,538,371 | A | 9/1985 | Howard | |
| 4,574,511 | A | 3/1986 | Csonger | |
| 4,706,402 | A | 11/1987 | Csonger | |
| 4,707,941 | A | 11/1987 | Eastman | |
| 4,726,296 | A | 2/1988 | Leshner et al. | |
| 4,739,572 | A | 4/1988 | Brandenburg | |
| 4,879,829 | A | 11/1989 | Miller et al. | |
| 4,939,862 | A | 7/1990 | Brandenberg | |
| 4,949,495 | A | 8/1990 | Mari | |
| 4,970,820 | A | 11/1990 | Miller et al. | |
| 5,301,449 | A | 4/1994 | Jackson | |
| 5,319,872 | A | 6/1994 | Bammate | |
| 5,402,594 | A | 4/1995 | Switzer | |
| 5,563,365 | A | 10/1996 | Dineen et al. | |
| 6,178,683 | B1 | 1/2001 | Williams | |
| 6,754,987 | B1 | 6/2004 | Cheng et al. | |
| 6,810,616 | B2 | 11/2004 | Tal et al. | |
| 6,817,134 | B2 | 11/2004 | Newman | |
| 7,059,077 | B2 | 6/2006 | Tal et al. | |
| 7,383,657 | B2 | 6/2008 | Pikielny | |
| 7,503,138 | B2 | 3/2009 | Tal et al. | |
| 7,637,048 | B2 | 12/2009 | Tal et al. | |
| 7,805,874 | B2 | 10/2010 | Tal et al. | |
| 7,866,080 | B2 | 1/2011 | Tucker | |
| 8,356,441 | B2 | 1/2013 | Meinel | |
| 8,453,366 | B2 | 6/2013 | Gray | |
| 8,484,874 | B2 | 7/2013 | Kim | |
| 8,650,792 | B1 | 2/2014 | Overmars | |
| D715,888 | S | 10/2014 | Padgett | |
| 8,915,007 | B1 | 12/2014 | Williams | |
| 8,931,199 | B1 | 1/2015 | Cauley, Jr. et al. | |
| 9,003,687 | B2 | 4/2015 | Cauley, Jr. et al. | |
| 9,212,859 | B1 | 12/2015 | Tal et al. | |
| 9,273,917 | B1 * | 3/2016 | Buckner | F41A 9/83 |
| D753,781 | S | 4/2016 | Cauley, Jr. et al. | |
| D755,325 | S | 5/2016 | Cauley, Jr. et al. | |
| 9,335,108 | B2 | 5/2016 | Cauley, Jr. et al. | |
| 2004/0020096 | A1 | 2/2004 | Tal et al. | |
| 2004/0159035 | A1 | 8/2004 | Newman | |
| 2004/0159036 | A1 | 8/2004 | Newman | |
| 2007/0017140 | A1 | 1/2007 | Pikielny | |
| 2007/0107291 | A1 | 5/2007 | Tal et al. | |
| 2008/0184608 | A1 | 8/2008 | Tal et al. | |
| 2009/0044440 | A1 | 2/2009 | Tal et al. | |
| 2012/0192477 | A1 | 8/2012 | Kim | |
| 2012/0222343 | A1 | 9/2012 | Kim | |
| 2013/0061505 | A1 | 3/2013 | Faifer | |
| 2013/0067788 | A1 | 3/2013 | Gray | |
| 2013/0192117 | A1 | 8/2013 | Meinel | |
| 2013/0232843 | A1 | 9/2013 | Bajuelo | |
| 2014/0033592 | A1 | 2/2014 | Fiorucci | |
| 2014/0223792 | A1 | 8/2014 | Socivoi | |
| 2014/0298704 | A1 | 10/2014 | Niccum | |
| 2014/0373421 | A1 | 12/2014 | Hatch | |
| 2014/0373744 | A1 | 12/2014 | Padgett et al. | |
| 2015/0075053 | A1 | 3/2015 | Kim | |
| 2015/0316341 | A1 | 11/2015 | Aguilar | |

FOREIGN PATENT DOCUMENTS

| | | |
|---|---|---|
| KR | 102011011338 A | 10/2011 |
| WO | 8503119 | 7/1985 |

OTHER PUBLICATIONS

McFadden Machine Company Incorporated Clip Loader the Ultimate Clip Loader, http://www.mcfaden.com/cliploader.html, 3 pages, Jul. 15, 2014.

'McFadden Machine Company Incorporated Lightnin' Grip Loader, http://www.mcfaden.com/product-p/lightnin-grip.htm, Aug. 12, 2015, 3 pages.

'McFadden Machine Company Incorporated Lightnin' Grip Loader Instructions, admitted prior art, 1 page.

Youtube 3pointi.com Box-to-Mag Loader, 3 screenshots of video, https://www.youtube.com/watch?v=2m1rYDpiQlw, 1 page, video uploaded Jun. 21, 2011.

Three Point Innovation's Box-to-Mag AR-15 Speed Loader—The Firearm Blog http://www.thefirearmblog.com/blog/2011/06/30/three-point-innovations-box-to-mag-ar-15-speed-loader/, 2 pages, posted Jun. 30, 2011.

* cited by examiner

FIREARM MAGAZINE LOADER

FIELD

The present disclosure generally relates to a loader for loading ammunition, and more particularly to a loader for loading ammunition into a magazine for a firearm.

BACKGROUND

Various types of firearms including rifles and handguns are configured to receive a magazine for feeding rounds of ammunition to a firing mechanism of the firearm. There are many types of firearm magazines, some of which are adapted to hold only a few rounds of ammunition, and others of which are adapted to hold tens to hundreds of rounds of ammunition. Loading ammunition into a magazine is conventionally performed by grabbing rounds by hand one at a time and positioning them individually into the magazine. This process can be time consuming, depending on the type and size of the magazine. In addition, this process can be tedious and cause hand fatigue.

There are various types of loaders which may be used to assist in loading ammunition into a magazine. Although existing loaders are an improvement over loading a magazine by hand, additional improvements are needed.

SUMMARY

One aspect of the present invention is directed to an apparatus for loading rounds of ammunition from stripper clips into a firearm magazine. Each round of ammunition includes a bullet end and an opposite tail end. The apparatus includes a holder for supporting rounds of ammunition on stripper clips to be loaded into the firearm magazine. The holder has a front, a rear, a top, a bottom, opposite sides, and a width extending between the opposite sides. The holder includes multiple slots extending widthwise of the holder. The holder is constructed for receiving rounds of ammunition on stripper clips from the top of the holder with the bullet ends leading the tail ends. Each slot is sized for receiving multiple rounds of ammunition on a stripper clip in a row extending widthwise of the holder. Each slot has an open top extending widthwise of the holder sized to permit the rounds of ammunition to be received in the slot while supported on the stripper clip. Each slot has at least one stripper clip support member constructed to engage the stripper clip when the rounds of ammunition on the stripper clip are received in the slot for loading into the firearm magazine. Each slot having at least one open end configured to permit the rounds of ammunition to be moved widthwise of the holder off of the stripper clip out of the slot through the at least one open end to be loaded into the firearm magazine.

Another aspect of the present invention is directed to a method of loading rounds of ammunition off stripper clips into a firearm magazine. The method includes providing a holder having a top, a bottom, a front, a rear, opposite left and right sides, and a width extending between the left and right sides. The method includes moving multiple rounds of ammunition on a first stripper clip into a first slot of the holder from the top of the holder, and moving multiple rounds of ammunition on a second stripper clip into a second slot of the holder from the top of the holder. The rounds of ammunition in the first slot are plunged widthwise of the holder off of the first stripper clip and out an open end of the first slot for loading the rounds of ammunition into the firearm magazine. The holder is moved with respect to the firearm magazine to position the second slot for loading the rounds of ammunition in the second slot into the firearm magazine. The rounds of ammunition in the second slot are plunged widthwise of the holder off of the second stripper clip out an open end of the second slot for loading the rounds of ammunition into the firearm magazine.

Another aspect of the present invention is directed to apparatus for loading rounds of ammunition from stripper clips into a firearm magazine. Each round of ammunition includes a bullet end and an opposite tail end. The apparatus includes a holder for supporting rounds of ammunition on a stripper clip to be loaded into the firearm magazine. The holder has a front, a rear, a top, a bottom, opposite sides, and a width extending between the opposite sides. The holder includes multiple slots. Each slot is sized for receiving multiple rounds of ammunition in a row while supported on a stripper clip. Each slot has at least one open end configured to permit the rounds of ammunition to be moved off of the stripper clip and out of the slot through the at least one open end to be loaded into the firearm magazine. A main body includes a magazine receiver configured to receive the firearm magazine to be loaded with the rounds of ammunition. The holder is sized and shaped to be supported by the main body for movement with respect to the main body for positioning the slots of the holder with respect to the firearm magazine. A plunger is configured for plunging rounds of ammunition off of the stripper clip and out the at least one open end of each slot for loading the rounds of ammunition into the firearm magazine. The apparatus includes a stripper clip ejector configured for ejecting the stripper clip from the holder.

Another aspect of the present invention is directed to a firearm magazine loader for loading rounds of ammunition into a firearm magazine. Each round of ammunition includes a bullet end and an opposite tail end. The loader includes a holder for supporting rounds of ammunition to be loaded into the firearm magazine. The holder has a front, a rear, a top, a bottom, opposite sides, and a width extending between the opposite sides. The holder includes at least one slot extending widthwise of the holder. The holder is constructed for receiving rounds of ammunition from the top of the holder with the bullet ends leading the tail ends. The at least one slot is sized for receiving multiple rounds of ammunition in a row extending widthwise of the holder. The at least one slot has at least one open end configured to permit the rounds of ammunition to be moved widthwise of the holder out of the slot through the at least one open end to be loaded into the firearm magazine. A plunger is configured for plunging rounds of ammunition from the holder for loading the rounds of ammunition into the firearm magazine. An ammunition transfer tool is configured for transferring rounds of ammunition into the at least one slot of the holder to be loaded into the firearm magazine. The ammunition transfer tool has a channel configured for holding multiple rounds of ammunition in a single file row extending along a length of the channel. The ammunition transfer tool is selectively positionable with respect to the holder for capturing rounds of ammunition away from the holder and transferring the rounds of ammunition to the holder. An ammunition transfer tool storage holder is configured for holding the ammunition transfer tool for storing the ammunition transfer tool on the loader.

Yet another aspect of the present invention is directed to a method of loading rounds of ammunition into a firearm magazine. Each round includes a bullet end and an opposite tail end. The method includes providing a firearm magazine loader including a holder having a top, a bottom, a front, a rear, opposite left and right sides, and a width extending between the left and right sides. The method includes providing a row of rounds of ammunition, and capturing tail ends of rounds of ammunition of the row in a channel of an ammunition transfer tool. The rounds of ammunition having the tail ends captured by the channel are moved into position with respect to a slot of a firearm magazine loader such that the rounds of ammunition are each at least partially in the slot or above and in register with a top of the slot. While the rounds of ammunition are in position with respect to the slot, the tail ends of the rounds of ammunition are released from the channel to leave the rounds of ammunition in the slot by moving the ammunition transfer tool with respect to the rounds of ammunition. The rounds of ammunition in the slot are plunged widthwise of the holder out an open end of the slot for loading the rounds of ammunition into the firearm magazine.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
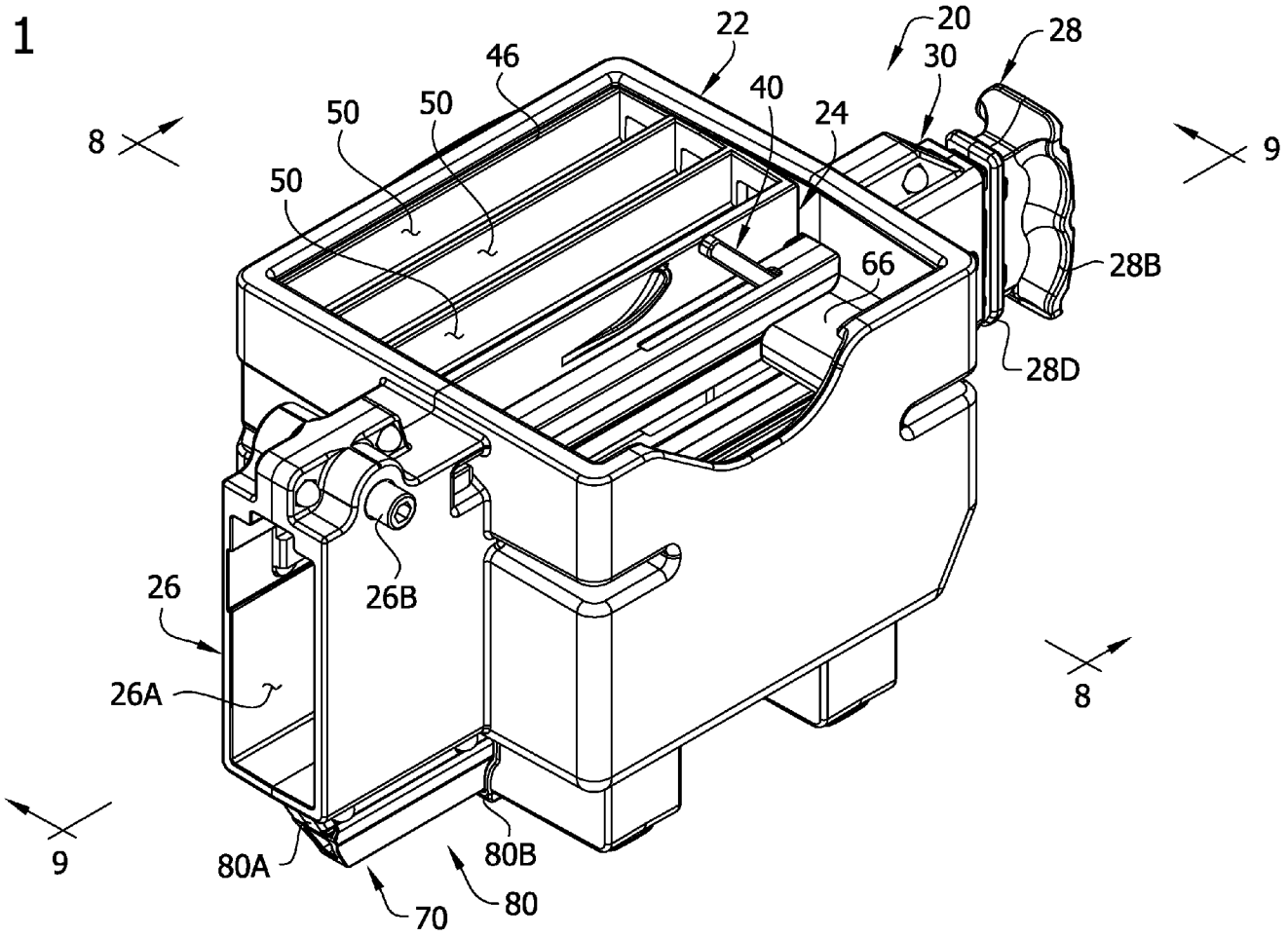
FIG. 1 is a front perspective of a firearm magazine loader embodying aspects of the present invention.

Referring to FIG. 1, a firearm magazine loader embodying aspects of the present invention is designated generally by the reference number 20. As will become apparent, the loader is adapted for loading several rounds of ammunition into a firearm magazine M (see, e.g., FIG. 9) in a relatively short time period. The loader 20 is configured for reducing hand fatigue associated with loading the magazine M. The loader can be used for loading ammunition from stripper clips into the magazine M. In some methods of using the loader 20, ammunition not on a stripper clip can be transferred from retail packaging or another storage container into the loader by hand or without touching the ammunition by hand. Ammunition in the loader 20 can be loaded in the magazine M by operating the loader.

Figure 2:
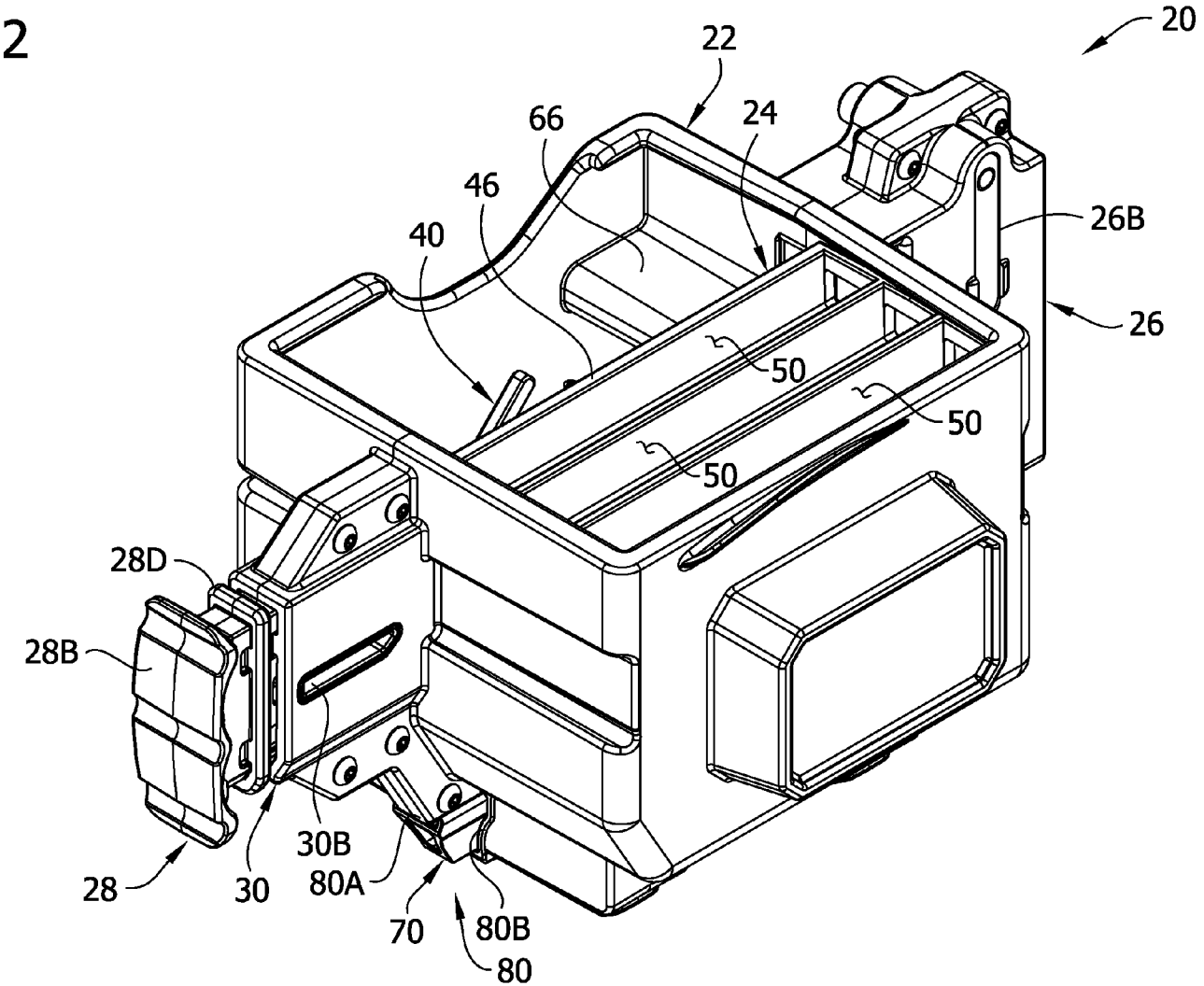
FIG. 2 is a rear perspective of the firearm magazine loader of FIG. 1.

As shown in FIGS. 1 and 2, the loader 20 generally includes a main body 22, an ammunition carrier 24 in the main body, a magazine receiver 26 for holding a magazine M to be loaded, an ammunition plunger 28, and a plunger guide 30 in which the plunger is selectively movable. As will become apparent, ammunition is held in the ammunition carrier 24, the carrier travels in the main body 22 to position the ammunition for loading into the magazine M, and the plunger 28 is selectively movable in a reciprocating fashion to thrust ammunition from the carrier 24 into the magazine.

The main body 22 has a generally rectangular shape and a hollow interior defining a track for guiding movement of the ammunition carrier 24 in the main body. The main body 22 includes an open top, which can optionally include a door or cover (not shown). A spring 32 (broadly "biasing member") (see FIGS. 3 and 8) is positioned inside the main body 22 in a cavity defined by the rear wall behind the carrier 24. As explained in further detail below, the spring 32 applies a force on the carrier 24 biasing it toward the front end of the main body. Other types of springs or other biasing members can be used without departing from the scope of the present invention.

The magazine receiver 26 extends laterally with respect to the main body 22. The magazine receiver 26 includes a passage 26A (FIG. 3) having an open end opening into the interior of the main body 22 and an opposite open end adapted for receiving the magazine M in the passage. The passage 26A has a generally rectangular cross section corresponding closely to the generally rectangular cross section of the magazine M. The passage 26A defines a socket for receiving the loading end of the magazine M and securing it in position for receiving ammunition from the carrier 24. The magazine receiver 26 includes a retainer 26B for securing the magazine M in the passage 26A. The retainer 26B includes a catch that extends into the passage 26A for engaging an opening on the magazine M. The catch secures the magazine M in the passage 26A much like the magazine M would be secured in a receiver of a firearm. The retainer 26B is selectively releasable by pressing a button to disengage the catch from the magazine M for permitting it to be removed from the receiver 26. Other types of magazine receivers can be used without departing from the scope of the present invention.

Figure 9:
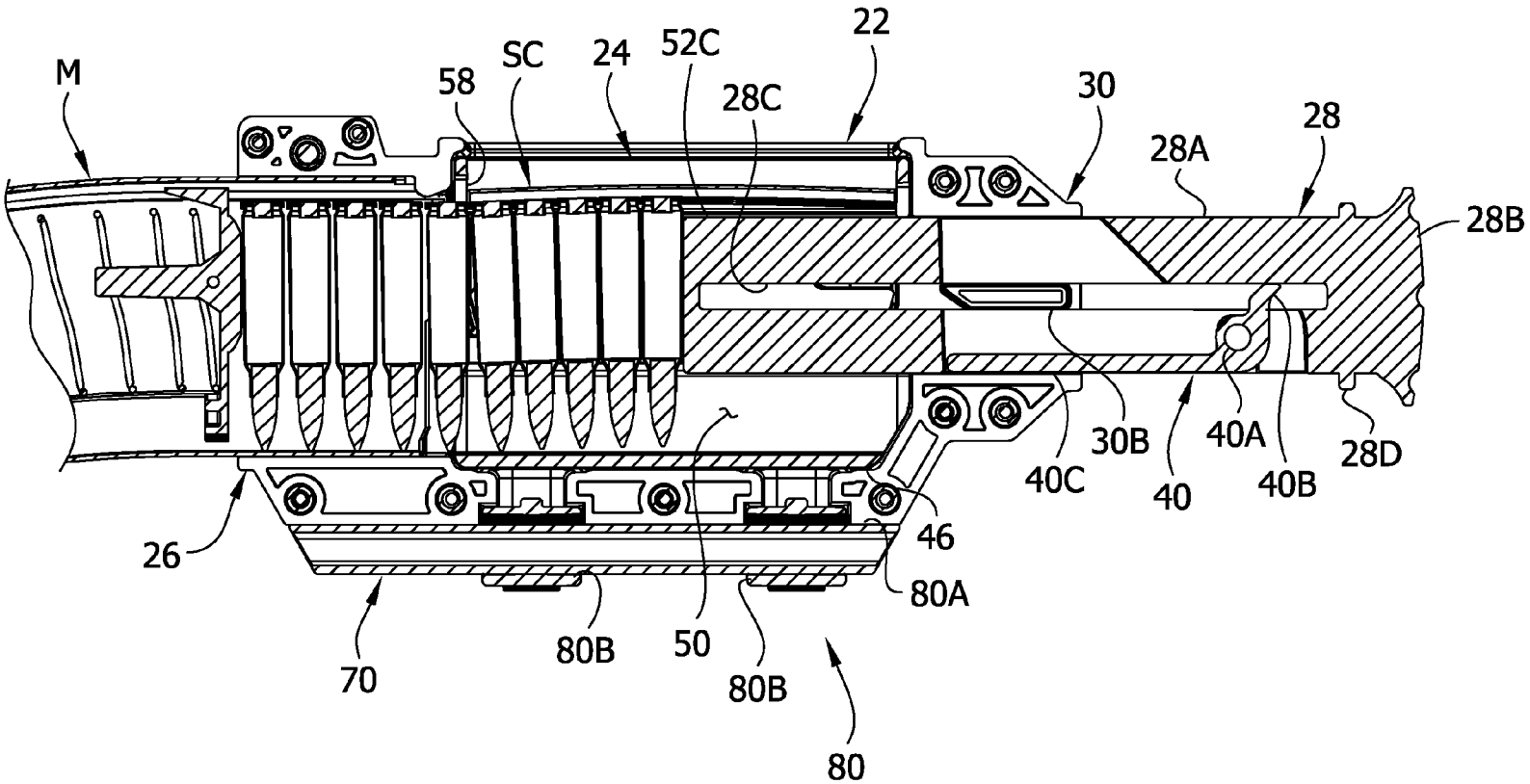
FIG. 9 is a section of the firearm magazine loader taken in the plane including line 9--9 shown in FIG. 1, a slot of the ammunition carrier being shown in register with a plunger of the firearm magazine loader, the plunger shown as having plunged some of the rounds of ammunition off the stripper clip and into a firearm magazine.
Figure 10:
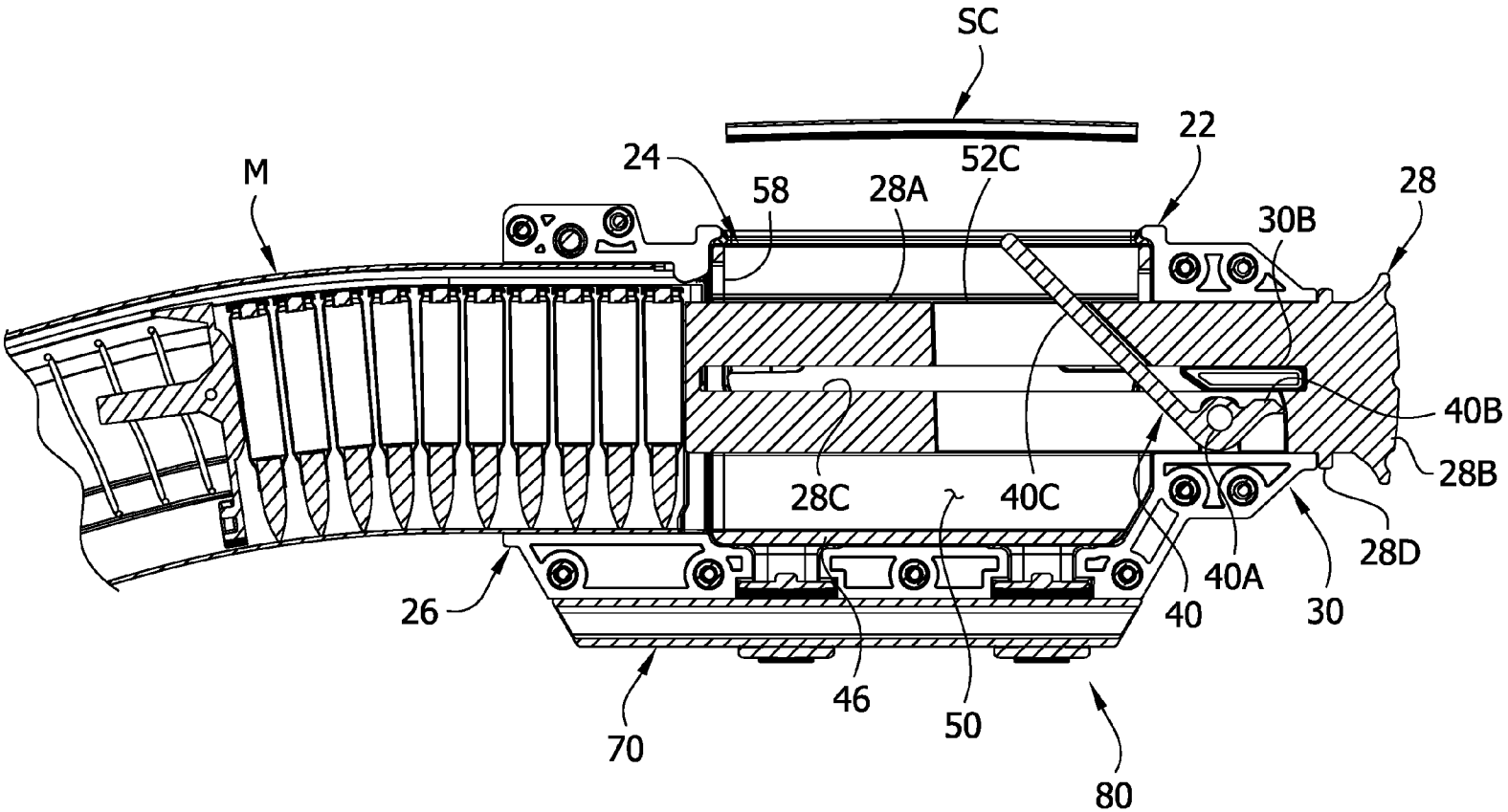
FIG. 10 is a section similar to FIG. 9 but showing the plunger having plunged all of the rounds of ammunition off the stripper clip and into the firearm magazine, an ejector of the firearm magazine loader being shown as having ejected the stripper clip from the loader.

In FIGS. 9 and 10, a magazine M for an AR-15 rifle is shown mounted in the magazine receiver 26. The magazine M is configured for holding ammunition such as .223 caliber rounds. It will be understood that the AR-15 magazine M is illustrated by example without limitation and that other types and configurations of magazines (e.g., configured for holding other caliber ammunition) can be used without departing from the scope of the present invention. For example, the basic features of the loader 20 can be maintained but changed in dimension etc. to adapt for receiving other magazines and/or loading other sizes of ammunition.

The plunger guide 30 extends laterally with respect to the main body 22 opposite the magazine receiver 26. The plunger guide 30 includes a passage 30A (FIG. 3) having an open end opening into the interior of the main body 22 and an opposite open end for receiving the plunger 28. As explained in further detail below, in use, the plunger 28 can be actuated in a reciprocating fashion by a user by pulling the distal end of the plunger out of the main body 22 (e.g., so the distal end is positioned in the plunger guide 30) and pushing the distal end of the plunger back into the main body. Pushing the plunger 28 into the main body 22 thrusts ammunition from the carrier 24 into the magazine M mounted on the magazine receiver 26. Other types of plunger guides can be used without departing from the scope of the present invention.

The plunger 28 includes an elongate shaft 28A and a handle 28B. The sides of the shaft 28A include closed end channels which engage protrusions in the passage 26A to prevent the plunger 28 from being removed from the plunger guide 30. In addition, the shaft 28A includes a slot 28C passing through the shaft and extending along the length of the shaft that receives a guide member in the form of a rib 30B extending across the passage 30A in the plunger guide 30 (FIGS. 9 and 10) to assist in preventing complete removal of the shaft from the guide. It will be appreciated the guiding of the plunger shaft 28A by such structure in the plunger guide 30 assists in maintaining the plunger shaft oriented properly for plunging ammunition widthwise of the carrier 24, even when relatively high plunging force is applied for overcoming resistance of the ammunition entering the magazine M. The plunger shaft 28A has a distal end adapted for engaging the ammunition in the carrier 24 and pushing it into the magazine M. The handle 28B is connected to the proximal end of the shaft 28A and is adapted for gripping by a user for pulling the plunger 28 out of the interior of the main body 22 and for pushing the plunger 28 back into the interior. The plunger 28 is shown in a fully plunged position in FIG. 10. In this position, a stop 28D on the plunger shaft 28A in the form of a circumferential flange engages the end of plunger guide 30 to prevent further movement of the plunger into the main body 22. The plunger shaft 28A includes a longitudinal or plunging axis which extends toward the magazine receiver 26 when the plunger 28 is received in the plunger guide 30. The plunger shaft 28A extends through the main body 22 into the magazine receiver 26 when in the fully plunged position.

As shown in FIGS. 9 and 10, a stripper clip ejector 40 is provided for ejecting stripper clips SC from the carrier 24 after ammunition has been stripped from the stripper clip by the plunger 28. In the illustrated embodiment, the stripper clip ejector 40 is located in a cavity in the plunger shaft 28A and mounted on the plunger 28 by a pivot connection 40A. The stripper clip ejector 40 is generally L-shaped and includes a relatively short trip arm 40B and a relatively long ejection arm 40C extending in transverse directions with respect to the pivot connection 40A. The stripper clip ejector 40 has a non-ejecting position (e.g., FIG. 9) and an ejecting position (e.g., FIG. 10). Operation of the stripper clip ejector 40 will be explained in further detail below.

Figure 3:
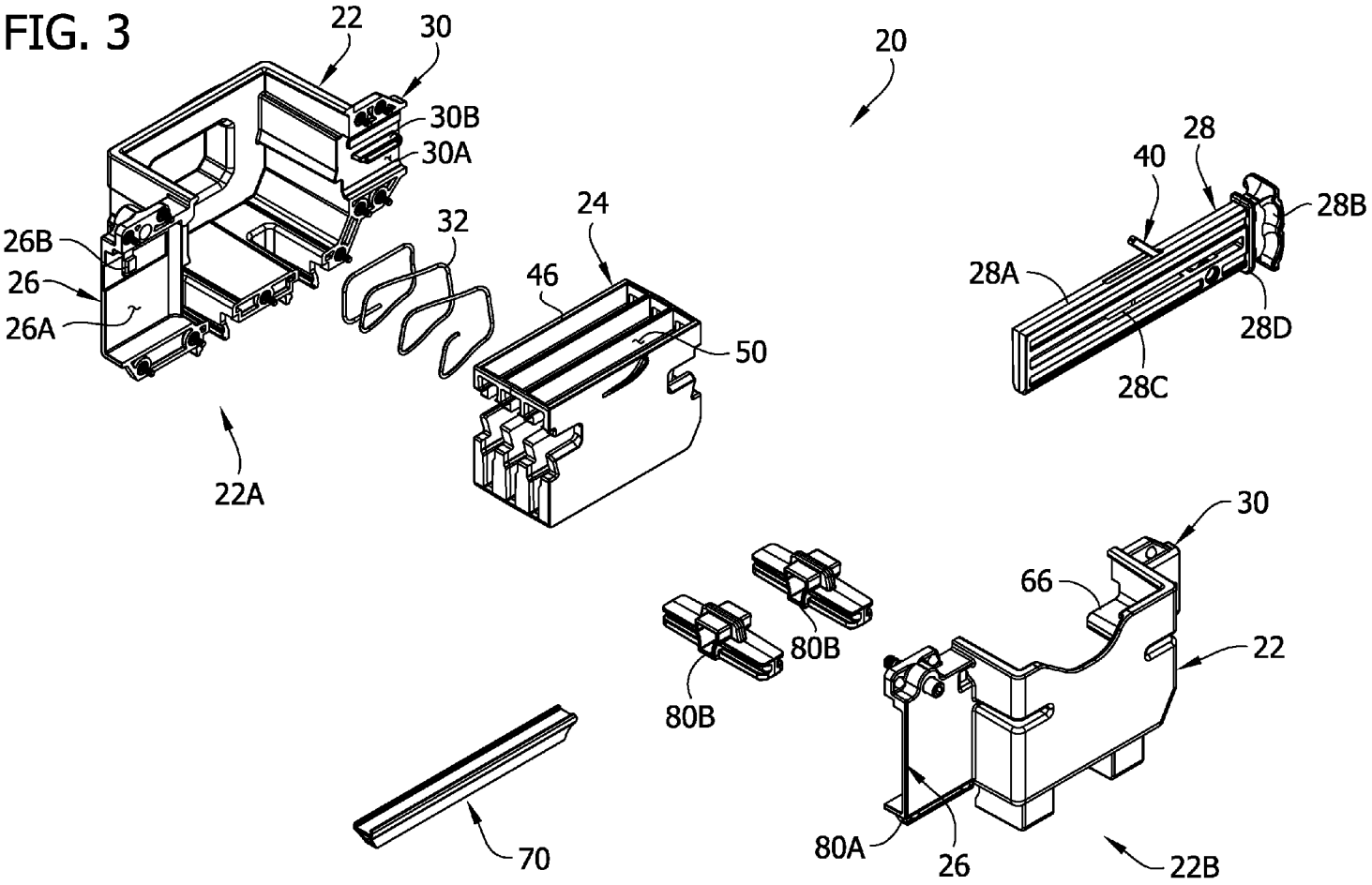
FIG. 3 is an exploded front perspective of the magazine loader.

As shown in FIG. 3, in the illustrated embodiment, the main body 22 is formed by two shell-like pieces 22A, 22B secured together by fasteners (e.g., screws). The plunger guide 30 and the magazine receiver 26 are formed in two pieces as part of the respective shell pieces 22A, 22B. For example, the pieces 22A, 22B can be formed of injection molded plastic. In manufacture, the spring 32, carrier 24, and plunger 28 can be positioned between the shell-like pieces 22A, 22B before they are secured together to capture the spring, carrier, and plunger. The spring 32 can be made of metal or any other suitable material. The plunger 28 and carrier 24 can be formed of injection molded plastic. Other suitable materials for the parts described herein can be used without departing from the scope of the present invention.

Figure 4:
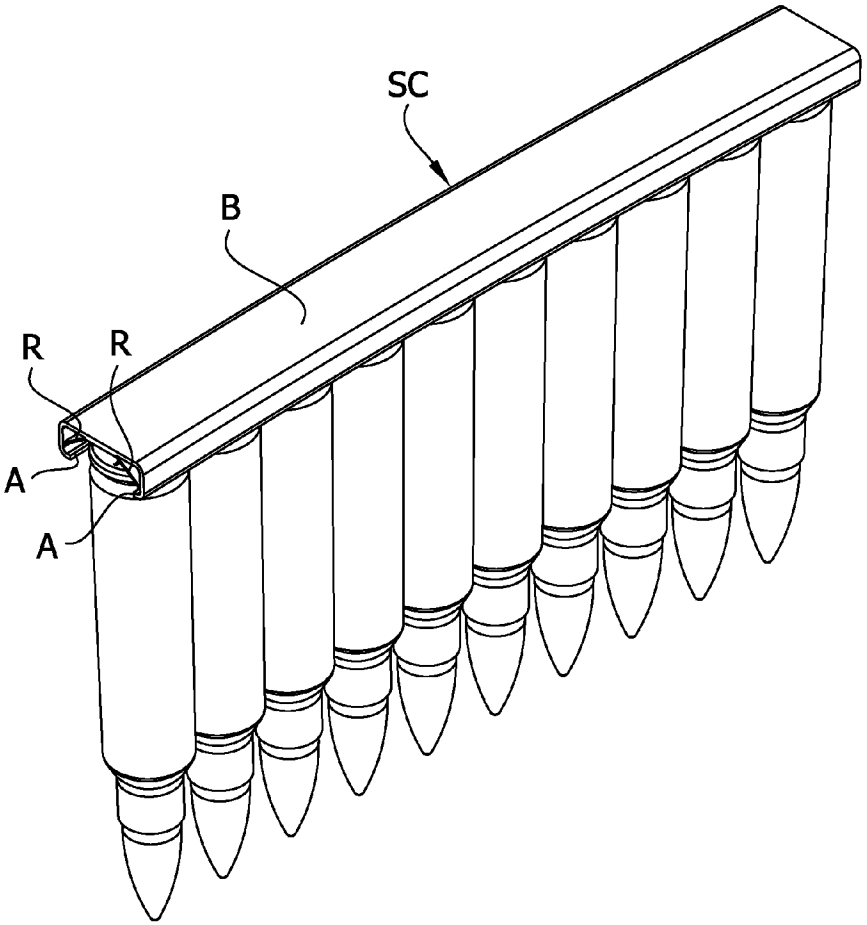
FIG. 4 is a perspective of ten rounds of ammunition on a stripper clip.

Referring now to FIG. 4, ten rounds of ammunition are shown on a stripper clip SC. The loader 20 disclosed herein can be used to load ammunition from the stripper clip SC into the firearm magazine M. The stripper clip SC includes an elongate body B having a C-shaped cross section defining an interior for receiving tail ends of the rounds of ammunition. The stripper clip body B has opposite open ends for permitting tail ends of the rounds of ammunition to be received into the interior of the body. The stripper clip SC includes a resilient retainer R extending along the length of and housed in the body B. The tail ends of the rounds of ammunition are retained in the interior of the body B by engagement with arms A of the stripper clip in grooves of the tail ends of the rounds and the retainer R pressing against the tail ends of the rounds to bias them against the arms. In the illustrated embodiment, the stripper clip body B is curved between front and rear ends of the body. It will be appreciated that various types of stripper clips are known (e.g., having straight instead of curved bodies, having other types of bodies, and/or omitting the retainer), and other types of stripper clips can be used without departing from the scope of the present invention.

Figure 5:
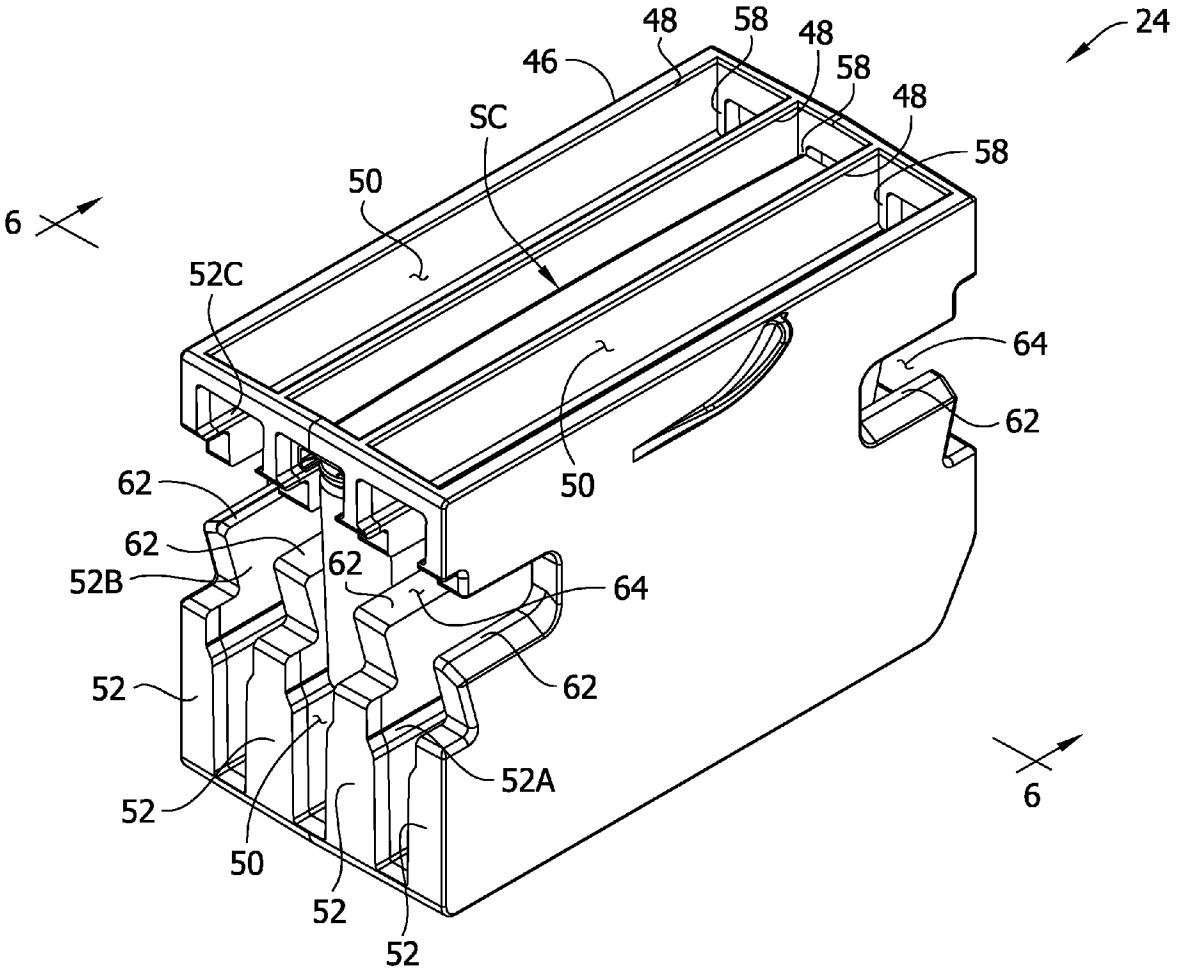
FIG. 5 is a front perspective of an ammunition carrier of the firearm magazine loader, the stripper clip and rounds of ammunition being shown in a middle slot of the carrier.

Referring to FIG. 5, the carrier 24 includes a holder 46 adapted for holding a plurality of rounds of ammunition, either loose or on stripper clips SC, in an array including multiple rows. The holder 46 includes a front end and a rear end (to the right and left, respectively, in FIG. 5). The holder 46 includes top, bottom, left, and right sides and a travel axis extending between the front and rear ends. The carrier 46 travels along the travel axis in the main body 22. The top of the holder 46 includes rectangular openings 48 extending between the left and right sides of the holder sized for receiving multiple rounds of ammunition while on the stripper clip SC. The holder 46 includes multiple slots 50 extending downward from respective openings 48. In the illustrated embodiment, there are three slots 50 sized for receiving ten rounds each, for a total of thirty rounds. The slots 50 extend transversely with respect to the travel axis and widthwise with respect to the holder 46. The slots 50 are defined by upstanding partitions 52 which extend between the sides of the holder 46 and which are spaced from one another between the front and rear ends of the holder. The slots 50 open out of the opposite left and right sides of the holder 46 for permitting the plunger 28 to enter the slots from one side and to push the ammunition out the other side.

Figure 6:
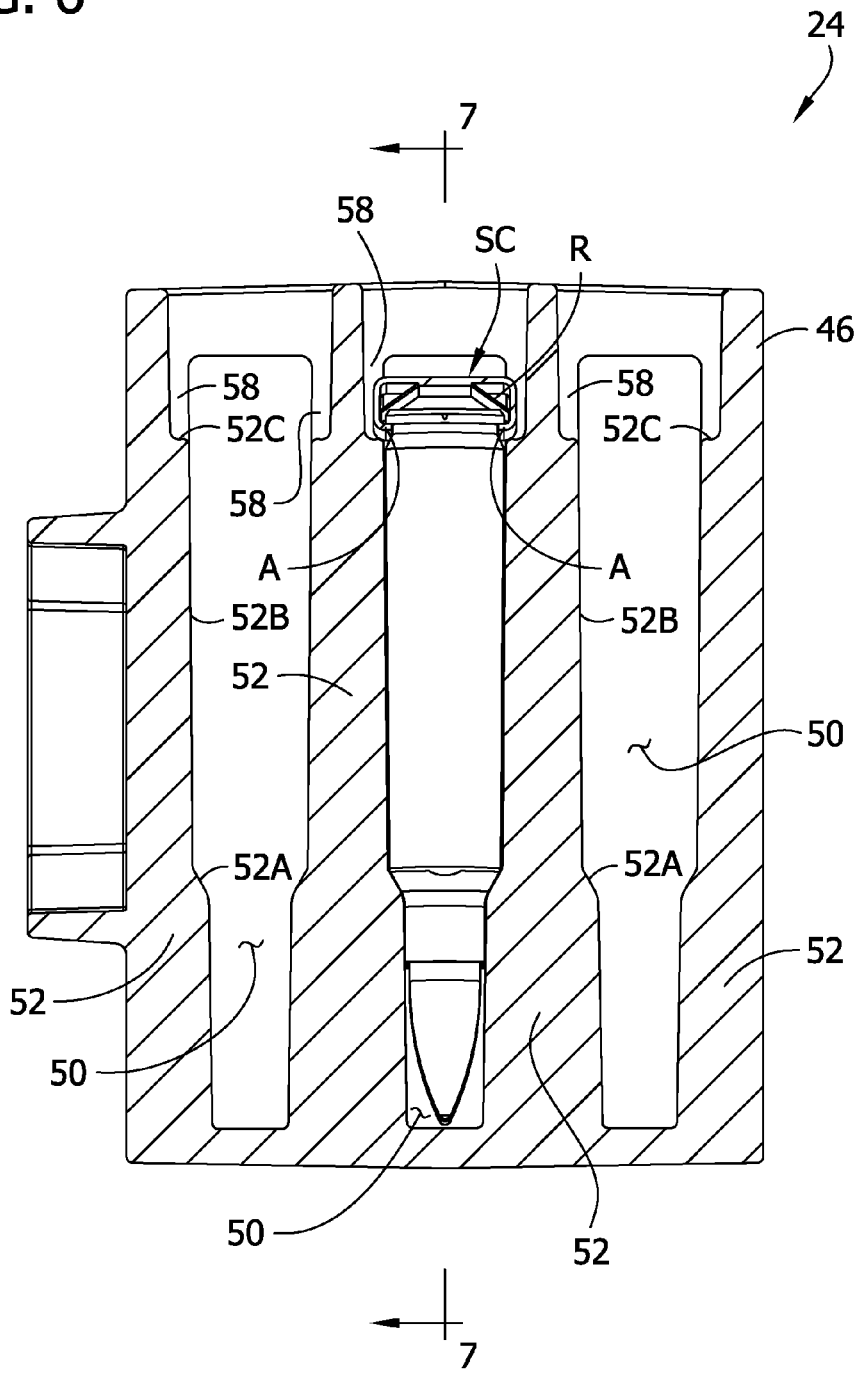
FIG. 6 is a section of the ammunition carrier, ammunition, and stripper clip taken in the plane including line 6--6 shown in FIG. 5.
Figure 7:
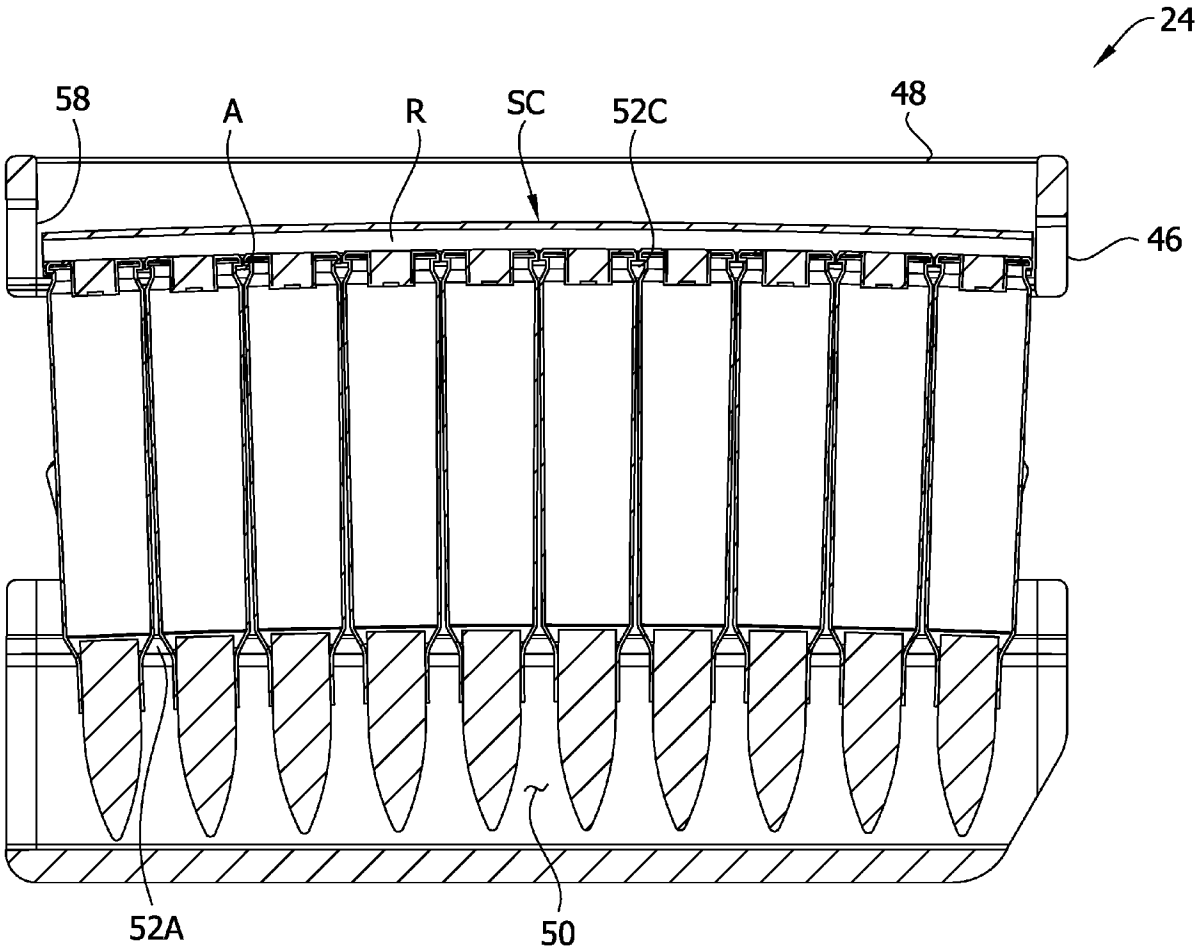
FIG. 7 is a section of the ammunition carrier, ammunition, and stripper clip taken in the plane including line 7--7 shown in FIG. 6.

Referring to FIGS. 6 and 7, the partitions 52 are shaped to provide the slots 50 with profiles configured for supporting rounds of ammunition in a generally upright position, bullet end down, and also for permitting sliding movement of the rounds of ammunition along the slots when pushed by the plunger 28 toward the magazine receiver 26. Each slot 50 includes, at a lower end, outwardly tapered shoulders 52A adapted for engaging the shoulder of the rounds in generally flush engagement. Above the shoulders 52A, each slot includes generally parallel walls 52B defining a space corresponding to the width of a cylindrical body of the ammunition casing. Each slot 50 includes, at an upper end, shelves 52C (broadly "stripper clip support members") on opposite front and rear sides of the slot. The space between the partitions 52 above the shelves 52C is greater than the space between the partitions below the shelves. The open tops 48 of the slots 50 and the space above the shelves 52C defines a gap between the front and rear sides of the slots sized to permit the stripper clip SC to be received from above, so the stripper clip and the rounds of ammunition on the stripper clip are receivable in the slot together. Other configurations can be used without departing from the scope of the present invention. For example, the shelves 52C can be provided at the top of the holder 46, instead of being spaced below the top of the holder.

It will be appreciated that the slots 50 are constructed for receiving rounds on a stripper clip SC or loose rounds of ammunition not on a stripper clip. Loose rounds received in the slots 50 will be positioned vertically in the slot based on engagement of the rounds with the shoulders 52A of the slots. The vertical position of rounds on stripper clips SC in the slots can be determined by similar engagement of the rounds with the shoulders 52A of the slots and/or by engagement of the stripper clips SC with the shelves 52C. As shown in FIG. 7, in the illustrated embodiment, the curvature of the stripper clip SC causes a midsection of the stripper clip to be elevated above the shelf 52C midway along the slot, and the rounds of ammunition to be slightly above the shoulders 52A of the slot midway along the slot. However, at the opposite ends of the slot 50, the tapered portions of the rounds engage the shoulders 52A of the slot and/or the stripper clip SC rests on the shelves 52C.

As shown in FIGS. 5 and 6, the slots 50 include blockers 58 adjacent ends of the slots for blocking the stripper clip from exiting open ends of the slots. In the illustrated embodiment, the blockers 58 comprise walls at the right open ends of the slots 50 on front and rear sides of the open end. The blockers 58 are formed as one piece with the main body 22 and extend upward from the shelves 52C. The blockers 58 are spaced from one another to permit tail ends of the rounds of ammunition to pass therebetween out of the open end of the slot 50. The blockers 58 are positioned to engage left and right sides of an end of the stripper clip SC to maintain the stripper clip in the slot when ammunition is plunged off the stripper clip and out of the open end of the slot. Other types of blockers can be used without departing from the scope of the present invention.

As shown in FIG. 5, each of the partitions 52 includes a notch 62 adjacent its upper right and left sides. The notches 62 are positioned in register with each other along the length of the holder 46 for defining channels 64 (FIG. 5) in the holder extending generally parallel to the travel axis of the holder. The channels 64 are adapted for receiving stops 66 (FIGS. 1, 2, and 8) for permitting the stops to engage ammunition in the holder 46 for indexing movement of the holder with respect to the plunger 28 and magazine receiver 26. The stops 66 protrude inward from inner surfaces of the main body 22. The stops 66 are positioned immediately forward of the passage 26A of the magazine receiver 26. As the carrier 24 moves under bias of the spring 32 from the rear end of the main body 22 toward the front end of the main body, the channels 64 slide over the stops 66. The stops 66 are positioned to engage rounds of ammunition in the holder 46 at opposite ends of the slots 50. For example, if rounds of ammunition are present in the first slot 50, rounds at the opposite ends of the slot engage respective stops 66 and stop movement of the carrier 24 at a position in which the row of ammunition in the first slot is positioned in register with the plunger 28 on one side and in register with the magazine receiver 26 on the opposite side.

Figure 8:
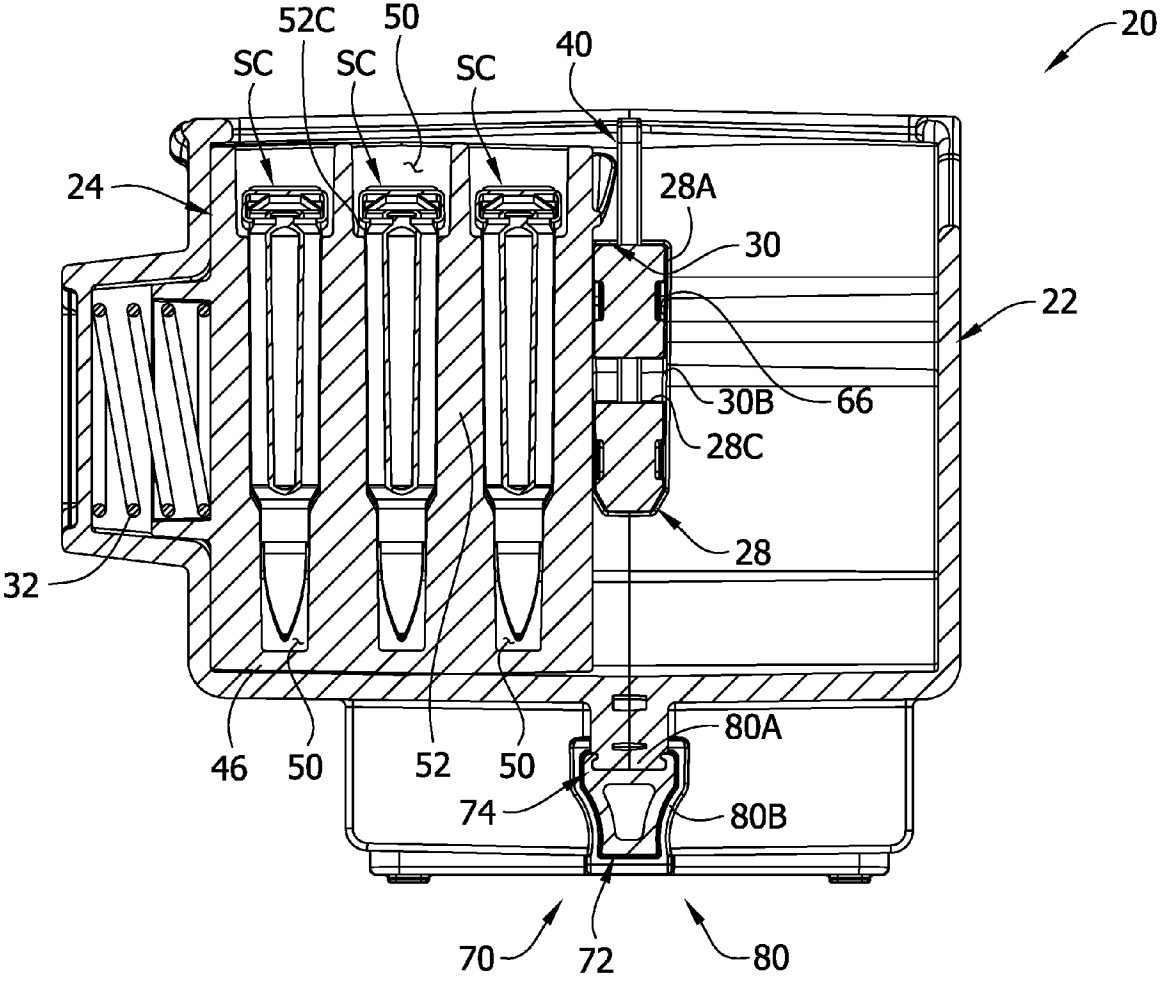
FIG. 8 is a section of the firearm magazine loader taken in the plane including line 8--8 shown in FIG. 1, the ammunition carrier being shown in a starting position, and ammunition on stripper clips being shown in three slots of the ammunition carrier.

An example method of using the loader 20 is illustrated in FIGS. 8-10. FIG. 8 illustrates the carrier 24 and plunger 28 in a starting position. The carrier 24 is fully loaded with ammunition, and in particular, a stripper clip SC of ammunition is shown in each slot 50 of the holder 46. In the starting position, the plunger 28 is between the front end of the carrier 24 and the stops 66. The plunger 28 engages the front end of the carrier 24. In this position, the spring 32 is compressed and the carrier 24 is in its fully retracted position. The plunger 28 holds the carrier 24 rearward against the biasing force of the spring 32.

After the carrier 24 is loaded with ammunition, the plunger is moved to a retracted position. The distal end of the plunger 28 is pulled out of the interior of the main body 22 into the plunger guide 30. The biasing force of the spring 32 causes the carrier 24 to move forward along the interior of the main body 22. The forward movement of the carrier 24 is stopped when rounds of ammunition in the first slot 50 engage the stops 66. In this position, the ammunition in the first slot 50 is positioned between and in register with the plunger 28 and the magazine receiver 26.

Referring to FIGS. 9 and 10, by pushing the plunger 28 into the holder 46 toward a plunged position, the ammunition in the first row of the holder is plunged off the stripper clip SC and into the magazine M. As the ammunition is plunged off the stripper clip SC, the stripper clip remains supported by or becomes supported by the shelves 52C. The shelves 52C support the empty stripper clip in position to be ejected by the ejector 40. As the plunger advances, the ejector 40 automatically ejects the empty stripper clip SC from the carrier. In particular, as the plunger 28 advances into the slot 50, the trip arm 40B advances toward the guide member 30B (also broadly referred to as a "trip member") in the plunger guide 30. As shown by comparison of FIGS. 9 and 10, upon engagement of the trip arm 40B of the ejector 40 with the guide member 30B, the ejector 40 pivots about the pivot connection 40A from the non-ejecting position to the ejecting position, which causes the ejection arm 40C of the ejector to strike the stripper clip SC to eject the stripper clip from the carrier 24. Ejection of the stripper clip SC relatively quickly after plunging the ammunition from the stripper clip (e.g., in the same plunging stroke of the plunger) is helpful to decrease the chance that the empty stripper clip could fall down into the holder 46, where it may jam the plunger 28 (e.g., obstruct retraction of the plunger) or jam advancement of the carrier 24. With the front end of the plunger 28 inside the first slot 50, the plunger 28 prevents the carrier 24 from advancing forward along the interior of the main body 22. As the distal end of the plunger 28 is withdrawn from the carrier 24, gravity causes the ejector 40 to move to the non-ejecting position, when the trip arm 40B no longer contacts the guide member 30B. When the distal end of the plunger 28 is out of the carrier 24, the carrier advances forward in the main body 22 until rounds of ammunition in the second slot 50 engage the stops 66. Thrusting of the plunger 28 back into the carrier 24 pushes the second row of ammunition into the magazine M and causes the ejector 40 to eject the empty stripper clip SC. Reciprocating movement of the plunger 28 in and out of the carrier 24 is repeated until the magazine M is full or the holder 46 has been emptied of ammunition. To reset the loader 20 for loading another batch of ammunition, the user may push the carrier 24 rearward against the biasing force of the spring 32. When the carrier 24 is fully seated in the main body 22, the distal end of the plunger 28 may be pushed back into the interior of the main body to block the carrier, and the loading process is repeated.

Figure 11:
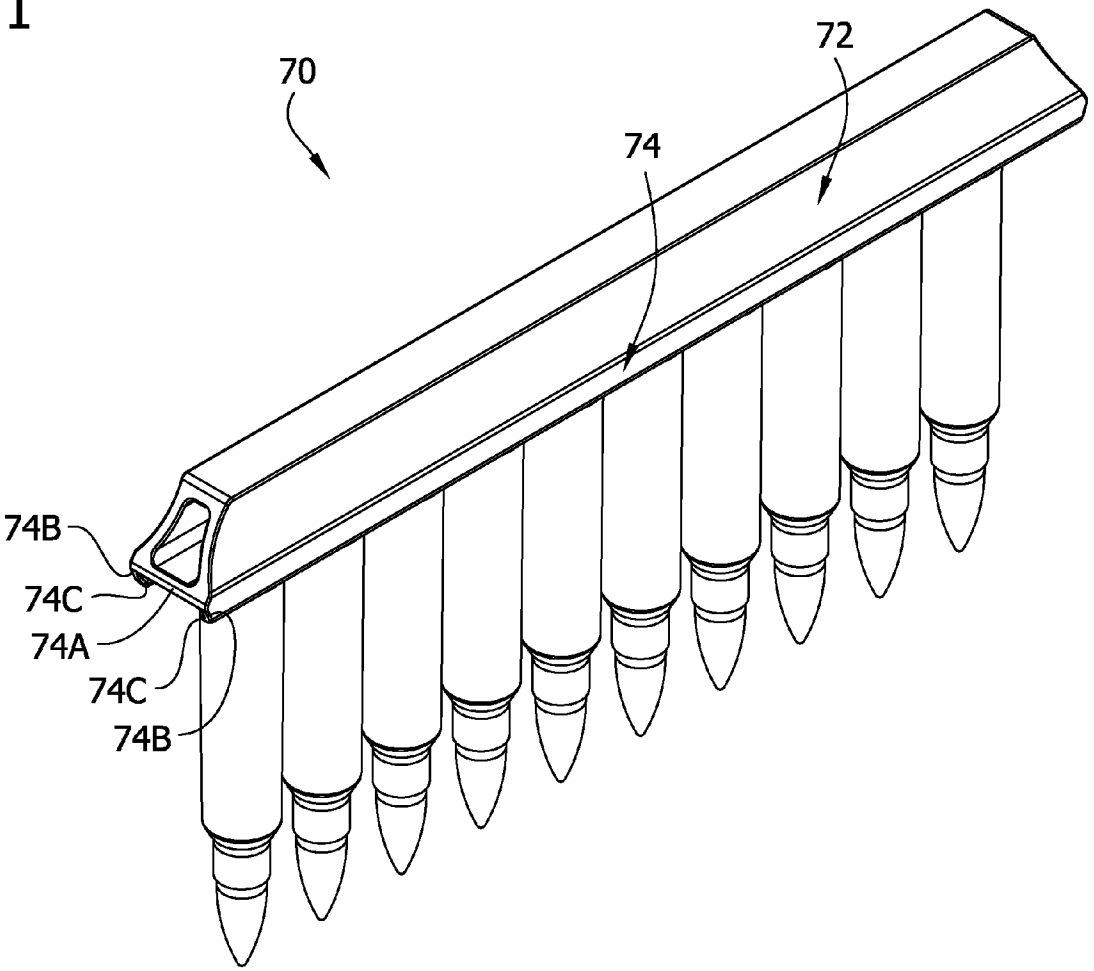
FIG. 11 is a perspective of an ammunition transfer tool embodying aspects of the present invention, rounds of ammunition being shown captured by the ammunition transfer tool.
Figure 12:
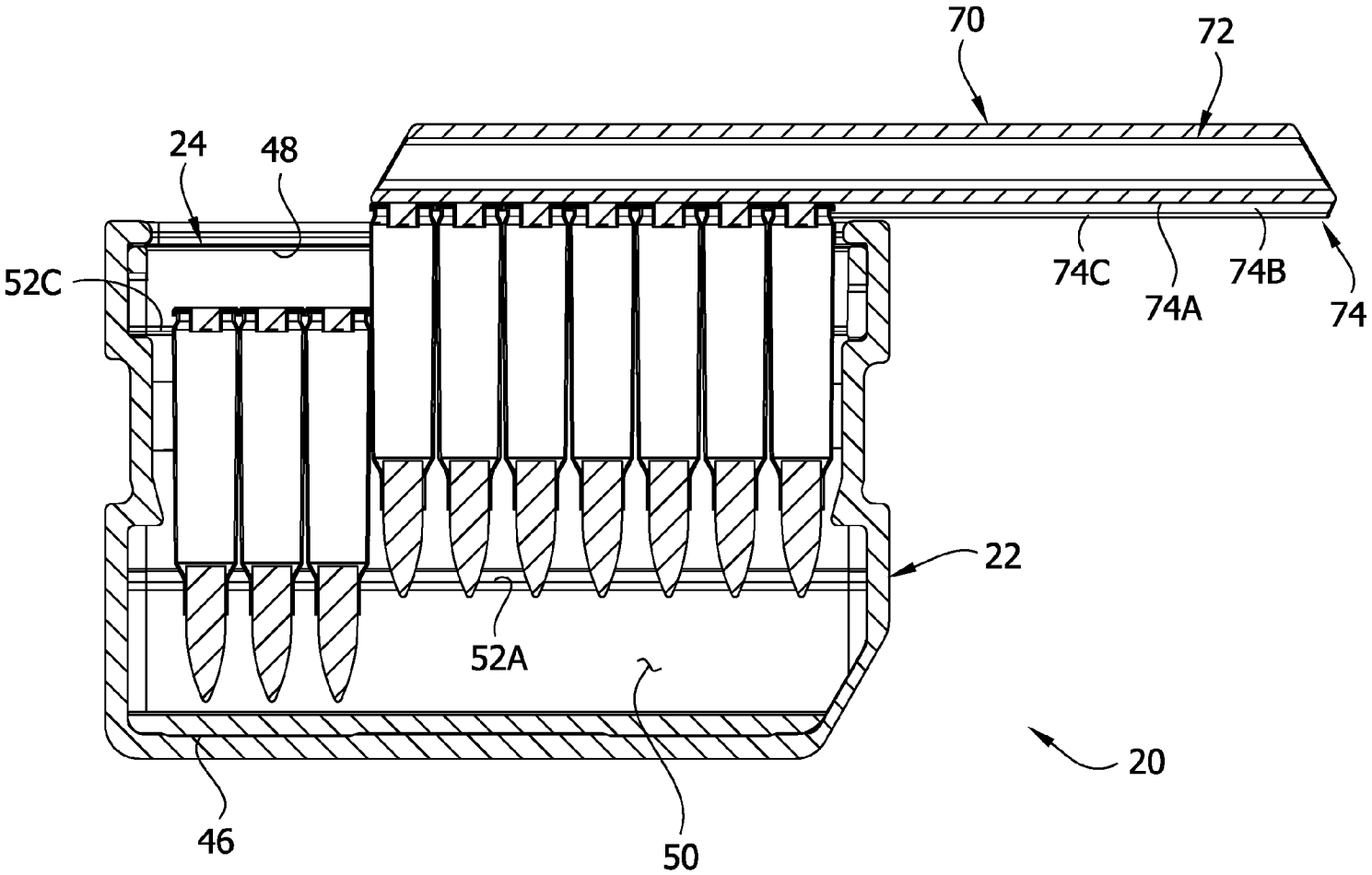
FIG. 12 is a section of the firearm magazine loader illustrating a use of the ammunition transfer tool for loading ammunition into a slot of the ammunition carrier.

Referring now to FIGS. 11 and 12, in another aspect of the present invention, an ammunition transfer tool 70 can be used to position ammunition in the slots of the carrier. The transfer tool 70 is elongate and includes an upper handle 72 and a lower channel 74 configured for capturing tail ends of rounds of ammunition. The channel 74 is configured for holding multiple rounds of ammunition in a single file row extending along the length of the channel, as shown in FIG. 11. The channel includes a web 74A, flanges 74B extending down from opposite sides of the web, and rails 74C extending inward toward each other from the flanges. The rails 74C are spaced from one another to define a gap sized for receiving the tail ends of the rounds of ammunition. The channel 74 includes opposite open ends configured to permit the tail ends of the rounds of ammunition to enter the channel for capturing the tail ends with the rails 74C. In the illustrated embodiment, the rails 74C are configured to be received in circumferential grooves in the tail ends of the rounds of ammunition for capturing the tail ends.

As shown in FIGS. 1, 2, and 8-10, the ammunition transfer tool 70 can be conveniently stored on the loader 20 on an ammunition transfer tool storage holder 80. In the illustrated example, the holder 80 comprises a storage head 80A and two passages 80B (FIGS. 4 and 9) in the lower end of the loader 20 sized for receiving the tool 70. As shown in FIG. 8, the storage head 80A has a roughly T-shaped cross section for reception in the channel 74 of the tool. To store the tool 70, an open end of the channel is positioned in register with an end of the storage head 80A, and the tool is moved down the storage head through the two passages 80B. The storage head 80A received in the channel 74, and the reception of the tool 70 in the passages 80B, desirably provides sufficient friction to prevent the tool from inadvertently sliding off the storage holder 80. For example, in the illustrated embodiment, the passages 80B are formed by resiliently compressible polymeric material, and the passages are sized to engage surfaces of the tool 70 to provide increased friction in the passages.

The tool 70 can be helpful in loading rounds of ammunition into the carrier 24 when the ammunition is not provided on stripper clips SC. For example, some commercially packaged ammunition is configured such that tail ends of the ammunition are exposed and arranged in one or more rows. To capture rounds of ammunition with the tool 70, an open end of the channel 74 is positioned in register with a tail end of a round of the row, and the open end is moved along the row to capture one-by-one the tail ends of rounds in the row. FIG. 11 shows ten rounds of ammunition captured by the tool 70. In this configuration, the rounds of ammunition can conveniently be transferred as a unit to the carrier 24. When all of the rounds of ammunition are at least partially in a slot 50 or above the slot, the tail ends of the rounds of ammunition are released one-by-one from an open end of the channel 74 by moving the channel with respect to the rounds to leave the rounds of ammunition in the slot. For example, FIG. 12 shows rounds of ammunition being loaded into a slot 50. The first three rounds of ammunition have already been released by the tool 70 and fallen into a seated position in the slot 50 in which the rounds rest on the shoulders 52A of the slot. As the tool 70 is moved to the right in the view of FIG. 12, the right most round engages the carrier 24 to limit movement of the row of ammunition with respect to the tool. As a result, the left-most round of ammunition on the tool 70 will fall from the open end of the channel 74 in succession until all of the rounds of ammunition are released from the tool and seated in the slot 50. Alternatively, all of the rounds of ammunition can be positioned on the tool 70 above and entirely out of the slot 50, and the user can use their hand to limit movement of the ammunition while moving the tool such that the rounds are released by the tool and fall into the slot. The process can be repeated for loading ammunition into all three slots 50 of the carrier 24. The ammunition in the slots 50 can be loaded into the magazine M in a similar fashion as described above.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

STATEMENTS OF INVENTION

The following are statements of invention described in the present application. Although the following statements are not currently presented as claims, the statements are believe to describe patentable subject matter and may be subsequently presented as claims.

A1. A firearm magazine loader for loading rounds of ammunition into a firearm magazine, each round of ammunition including a bullet end and an opposite tail end, the loader including:

a holder for supporting rounds of ammunition to be loaded into the firearm magazine, the holder having a front, a rear, a top, a bottom, opposite sides, and a width extending between the opposite sides, the holder including at least one slot extending widthwise of the holder, the holder being constructed for receiving rounds of ammunition from the top of the holder with the bullet ends leading the tail ends, the at least one slot being sized for receiving multiple rounds of ammunition in a row extending widthwise of the holder, the at least one slot having at least one open end configured to permit the rounds of ammunition to be moved widthwise of the holder out of the slot through the at least one open end to be loaded into the firearm magazine, a plunger configured for plunging rounds of ammunition from the holder for loading the rounds of ammunition into the firearm magazine, an ammunition transfer tool configured for transferring rounds of ammunition into the at least one slot of the holder to be loaded into the firearm magazine, the ammunition transfer tool having a channel configured for holding multiple rounds of ammunition in a single file row extending along a length of the channel, the ammunition transfer tool being selectively positionable with respect to the holder for capturing rounds of ammunition away from the holder and transferring the rounds of ammunition to the holder, and an ammunition transfer tool storage holder configured for holding the ammunition transfer tool for storing the ammunition transfer tool on the loader.

A2. A firearm magazine loader as set forth in claim A1 wherein the channel of the ammunition transfer tool includes rails extending along the length of the channel and defining a gap therebetween sized for receiving the rounds of ammunition, the channel including at least one end configured to permit the tail ends of the rounds of ammunition to enter the channel for capturing the tail ends with the rails for transferring the rounds of ammunition to the holder.

A3. A firearm magazine loader as set forth in claim A2 wherein the ammunition transfer tool storage holder includes a head sized and shaped to be captured in the channel of the ammunition storage tool for mounting the ammunition storage tool on the ammunition transfer tool storage holder.

B1. A method of loading rounds of ammunition into a firearm magazine, each round including a bullet end and an opposite tail end, the method comprising:

providing a firearm magazine loader including a holder having a top, a bottom, a front, a rear, opposite left and right sides, and a width extending between the left and right sides, providing a row of rounds of ammunition, capturing tail ends of rounds of ammunition of the row in a channel of an ammunition transfer tool, moving the rounds of ammunition having the tail ends captured by the channel into position with respect to a slot of a firearm magazine loader such that the rounds of ammunition are each at least partially in the slot or above and in register with a top of the slot, while the rounds of ammunition are in said position with respect to the slot, releasing the tail ends of the rounds of ammunition from the channel to leave the rounds of ammunition in the slot by moving the ammunition transfer tool with respect to the rounds of ammunition, and plunging the rounds of ammunition in the slot widthwise of the holder out an open end of the slot for loading the rounds of ammunition into the firearm magazine.

B2. A method as set forth in claim B1 wherein releasing the tail ends of the rounds of ammunition comprises moving the channel so the tail ends of the rounds of ammunition are released one at a time from an open end of the channel.

B3. A method as set forth in claim B1 further comprising storing the ammunition transfer tool by supporting the ammunition transfer tool on the firearm magazine loader in a storage position.

B4. A method as set forth in claim B1 wherein the tail ends of the rounds of ammunition are captured in the channel by moving an open end of the channel down the row from a first end of the row toward a second end of the row.

What is claimed is:

1. Apparatus for loading rounds of ammunition from stripper clips into a firearm magazine, each round of ammunition including a bullet end and an opposite tail end, the apparatus including:

a holder for supporting rounds of ammunition on stripper clips to be loaded into the firearm magazine, the holder having a front, a rear, a top, a bottom, opposite sides, and a width extending between the opposite sides, the holder including multiple slots extending widthwise of the holder, the holder being constructed for receiving rounds of ammunition on stripper clips from the top of the holder with the bullet ends leading the tail ends, each slot being sized for receiving multiple rounds of ammunition on a stripper clip in a row extending widthwise of the holder, each slot having an open top extending widthwise of the holder sized to permit the rounds of ammunition to be received in the slot while supported on the stripper clip, each slot having at least one stripper clip support member constructed to engage the stripper clip when the rounds of ammunition on the stripper clip are received in the slot for loading into the firearm magazine, each slot having at least one open end configured to permit the rounds of ammunition to be moved widthwise of the holder off of the stripper clip out of the slot through the at least one open end to be loaded into the firearm magazine.

2. Apparatus as set forth in claim 1 wherein the at least one stripper clip support member is configured to define the vertical position of the rounds of ammunition with respect to the holder when the rounds on the stripper clip are received in the slot and the stripper clip is supported by the at least one stripper clip support member in a position in which the rounds of ammunition are generally upright and at least the bullet tips of the rounds of ammunition are below the at least one stripper clip support member.

3. Apparatus as set forth in claim 1 wherein the at least one stripper clip support member comprises a shelf.

4. Apparatus as set forth in claim 1 wherein the at least one stripper clip support member comprises first and second stripper clip support members, the first stripper clip support member being positioned on a front side of the slot, and the second stripper clip support member being positioned on a rear side of the slot.

5. Apparatus as set forth in claim 4 wherein the first stripper clip support member comprises a first shelf and the second stripper clip support member comprises a second shelf.

6. Apparatus as set forth in claim 4 wherein the stripper clip support members are below the top of the holder.

7. Apparatus as set forth in claim 1 wherein the open top of the slot defines a gap between front and rear sides of the slot sized to permit the stripper clip to be received in the slot when the rounds of ammunition on the stripper clip are received in the slot.

8. Apparatus as set forth in claim 1 wherein each slot includes at least one blocker positioned adjacent said at least one open end, the at least one blocker being constructed to engage the stripper clip to prevent the stripper clip from exiting the slot through said at least one open end.

9. Apparatus as set forth in claim 1 further comprising a main body and a plunger, the main body including a magazine receiver configured to receive the firearm magazine to be loaded with the rounds of ammunition, the holder being sized and shaped to be supported by the main body for movement with respect to the main body for positioning the slots of the holder with respect to the firearm magazine, the plunger being supported by the main body and configured for plunging rounds of ammunition from the holder into the magazine receiver.

10. Apparatus as set forth in claim 9 further comprising a stripper clip ejector, the stripper clip ejector being constructed for ejecting a stripper clip empty of rounds of ammunition out of the top of the holder.

11. A method of loading rounds of ammunition off stripper clips into a firearm magazine, the method including:

providing a holder having a top, a bottom, a front, a rear, opposite left and right sides, and a width extending between the left and right sides, moving multiple rounds of ammunition on a first stripper clip into a first slot of the holder from the top of the holder, moving multiple rounds of ammunition on a second stripper clip into a second slot of the holder from the top of the holder, plunging the rounds of ammunition in the first slot widthwise of the holder off of the first stripper clip and out an open end of the first slot for loading the rounds of ammunition into the firearm magazine, moving the holder with respect to the firearm magazine to position the second slot for loading the rounds of ammunition in the second slot into the firearm magazine, and plunging the rounds of ammunition in the second slot widthwise of the holder off of the second stripper clip and out an open end of the second slot for loading the rounds of ammunition into the firearm magazine.

12. A method as set forth in claim 11 wherein moving the multiple rounds of ammunition on the first stripper clip into the first slot of the holder comprises supporting the first stripper clip on a stripper clip support to define the vertical position of the rounds of ammunition in the first slot.

13. A method as set forth in claim 11 further comprising automatically ejecting the first stripper clip from the holder after plunging the ammunition off the first stripper clip.

14. A method as set forth in claim 13 wherein the first stripper clip is ejected from the holder before positioning the second slot for loading the rounds of ammunition in the second slot into the firearm magazine.

15. Apparatus for loading rounds of ammunition from stripper clips into a firearm magazine, each round of ammunition including a bullet end and an opposite tail end, the apparatus including:

a holder for supporting rounds of ammunition on a stripper clip to be loaded into the firearm magazine, the holder having a front, a rear, a top, a bottom, opposite sides, and a width extending between the opposite sides, the holder including multiple slots, each slot being sized for receiving multiple rounds of ammunition in a row while supported on a stripper clip, each slot having at least one open end configured to permit the rounds of ammunition to be moved off of the stripper clip and out of the slot through the at least one open end to be loaded into the firearm magazine, a main body including a magazine receiver configured to receive the firearm magazine to be loaded with the rounds of ammunition, the holder being sized and shaped to be supported by the main body for movement with respect to the main body for positioning the slots of the holder with respect to the firearm magazine, a plunger configured for plunging rounds of ammunition off of the stripper clip and out the at least one open end of each slot for loading the rounds of ammunition into the firearm magazine, and a stripper clip ejector configured for ejecting the stripper clips from the holder.

16. Apparatus as set forth in claim 15 wherein the stripper clip ejector is positioned with respect to the plunger for actuation of the stripper clip ejector to eject the stripper clip in response to movement of the plunger.

17. Apparatus as set forth in claim 16 wherein the stripper clip ejector is mounted on the plunger.

18. Apparatus as set forth in claim 17 wherein the stripper clip ejector has a pivot connection with the plunger, the stripper clip ejector including a trip arm configured to cause the stripper clip ejector to pivot about the pivot connection when the plunger is plunged and an ejection arm configured to eject the stripper clip when the stripper clip ejector pivots about the pivot connection.

19. Apparatus as set forth in claim 15 wherein each slot includes at least one stripper clip support member positioned to support the stripper clip in position to be ejected by the stripper clip ejector.

20. Apparatus as set forth in claim 19 wherein the at least one stripper clip support member comprises a shelf.

* * * * *